US006032623A

United States Patent [19]

Yamagishi et al.

[11] Patent Number: 6,032,623

[45] Date of Patent: Mar. 7, 2000

[54] CONTROL APPARATUS AND CONTROL METHOD OF VARIABLE VALVE TIMING STRUCTURE

[75] Inventors: Yoichiro Yamagishi; Satoru Watanabe, both of Atsugi, Japan

[73] Assignee: Unisia Jecs Corporation, Atsugi, Japan

[21] Appl. No.: 09/090,878

[22] Filed: Jun. 5, 1998

[30] Foreign Application Priority Data

Jun. 11, 1997 [JP] Japan ..... 9-154039

[51] Int. Cl.[7] ..... F02D 13/00

[52] U.S. Cl. ..... 123/90.15; 123/90.17

[58] Field of Search ..... 123/90.15, 90.17, 123/90.31

[56] References Cited

U.S. PATENT DOCUMENTS 5,271,360 12/1993 Kano et al. ..... 123/90.17
5,562,071 10/1996 Urushihata et al. ..... 123/90.15
5,611,304 3/1997 Shinojima ..... 123/90.15

FOREIGN PATENT DOCUMENTS 7-233713 9/1995 Japan .
8-246820 9/1996 Japan .

*Primary Examiner*—Weilun Lo
*Attorney, Agent, or Firm*—Foley & Lardner

[57] ABSTRACT

In a hydraulic type variable valve timing structure having a construction for changing a phase of a cam shaft by controlling the current provided to a linear solenoid valve, and a change of said rotational phase corresponding to the increase of said current is limited by a stopper, a maximum current is provided for a predetermined time to the linear solenoid valve when a target value of the rotational phase is switched to the rotational phase being limited by the stopper, and thereafter, the current is lowered and maintained in the range where the rotational phase being limited by the stopper can be maintained.

14 Claims, 3 Drawing Sheets

CONTROL APPARATUS AND CONTROL METHOD OF VARIABLE VALVE TIMING STRUCTURE

BACKGROUND OF THE INVENTION (1) Field of the Invention

The present invention relates to a control apparatus and a control method of a variable valve timing structure for varying the opening/closing timing of an intake valve and/or an exhaust valve by changing the rotational phase of a cam shaft in an internal combustion engine.

(2) Related Art of the Invention

In the prior art, a variable valve timing structure for advancing or delaying the opening/closing timing of an intake valve and/or an exhaust valve by changing the rotational phase of the cam shaft was known (refer to Japanese Unexamined Patent Publication 7-233713, Japanese Unexamined Patent Publication 8-246820 and the like).

In the case where said variable valve timing structure is of a hydraulic type, with a structure where hydraulic pressure is controlled by controlling the duty of the current provided to a linear solenoid valve, the structure may be formed to limit the change of said rotational phase corresponding to the increase or decrease of the ON duty (current) by a stopper. For instance, when the stopper position (for example, the most advanced angle side) for limiting the change of rotational phase corresponding to the increase of the current is set as the target rotational phase, it was common to provide a 100% ON duty (maximum current) in order to move the rotational phase rapidly to said stopper position.

However, in the prior art, when the target rotational phase was set at said stopper position, the structure provided said 100% ON duty continuously even after the actual phase has been changed to the stopper position, which caused problems such as large power consumption and rising of coil temperature in the linear solenoid valve.

SUMMARY OF THE INVENTION

The present invention aims at solving the above-mentioned problems, and the object of the present invention is to provide a control apparatus and a control method of a variable valve timing structure wherein the rotational phase could be displaced to the stopper position with a good response, and the power consumption and the coil temperature when maintaining the stopper position could be controlled to a low value.

Moreover, the object of the present invention is to provide a control apparatus and a control method of a variable valve timing structure where a secured response character and a reduced power consumption could be gained stably without depending on the conditions such as the oil temperature or the power source voltage.

In order to achieve the above objects, the control apparatus and the control method of the variable valve timing structure according to the present invention is constructed so that when a target value of the rotational phase is switched to the stopper position limiting the change of rotational phase corresponding to the increase of current, after providing a maximum current for a predetermined time to a linear solenoid valve, the current is reduced and maintained to the value in the range where the rotational phase to be limited by the stopper can be maintained.

According to such a construction, the displacement of the rotational phase of the cam shaft to the stopper position can be performed with a good response by providing the maximum current, and at the same time, after reaching the stopper position, the current is lowered and maintained in the range where the stopper position can be maintained, which cuts down the power consumption and limits the rise of the coil temperature when maintaining the stopper position.

At this time, it is better to change the predetermined time for providing the maximum current according to the deviation of the target value before and after the switching.

According to such a construction, in correspondence to the fact that the time necessary for displacing the rotational phase of the cam shaft to the stopper position changes according to the deviation of the target value before and after the switching, the time for providing the maximum current can be controlled to a minimum value.

Moreover, it is possible to change the predetermined time for providing the maximum current according to the temperature of an operation oil of the variable valve timing structure.

According to such a construction, corresponding to the fact that the time necessary for displacing the rotational phase of the cam shaft to the stopper position changes according to the temperature of the operation oil, the time for providing the maximum current could be controlled to a minimum value.

Further, it is possible to change the predetermined time for providing the maximum current according to the power source voltage of the variable valve timing structure.

According to such a construction, corresponding to the fact that the response speed of the phase change differs according to the power source voltage, the time for providing the maximum current could be controlled to a minimum value.

Moreover, the construction may be formed so that the larger the deviation of the target value before and after switching is, the larger a basic value of the predetermined time for providing the maximum current is set, and at the same time, correcting the basic value so that the higher the temperature of the operation oil of the variable valve timing structure is, the smaller the basic value is set, and the higher the power source voltage of the variable valve timing structure is, the smaller the basic value is set, in order to determine the predetermined time for providing the maximum current.

According to such structure, the time for providing the maximum current can be limited to a minimum necessary value in correspondence to the deviation of the target value, the change in temperature of the operation oil or the power source voltage.

Further, in the case where the current of the solenoid valve is duty-controlled, when the target value of the rotational phase is switched to the rotational phase being limited by the stopper, it is better to provide a 100% ON duty for a predetermined time, and then reduce and maintain an ON duty set to have a larger value when the power source voltage of the variable valve timing structure is lower.

According to such a construction, even when the power source voltage is changed, the current neither too much nor too little for maintaining the stopper position can be gained by the duty-control.

Moreover, in the variable valve timing structure, it is preferable that the rotational phase limited by the stopper be set to a rotational phase on a most advanced angle side.

According to such a construction, the reduction of the current changes the phase to the most delayed angle side, but on the other hand, the phase can be changed with a good response when the target is the most advanced angle side, and at the same time, the consumption of power when maintaining the most advanced angle side can be saved, and the rising of coil temperature could be restrained.

The above and other objects of the present invention will become apparent from the following description of the embodiments in connection with the accompanied drawings.

DETAILED DESCRIPTION OF THE PREFERRED EMBODIMENT

The embodiment of the present invention will hereinafter be explained based on the drawings.

Figure 1:
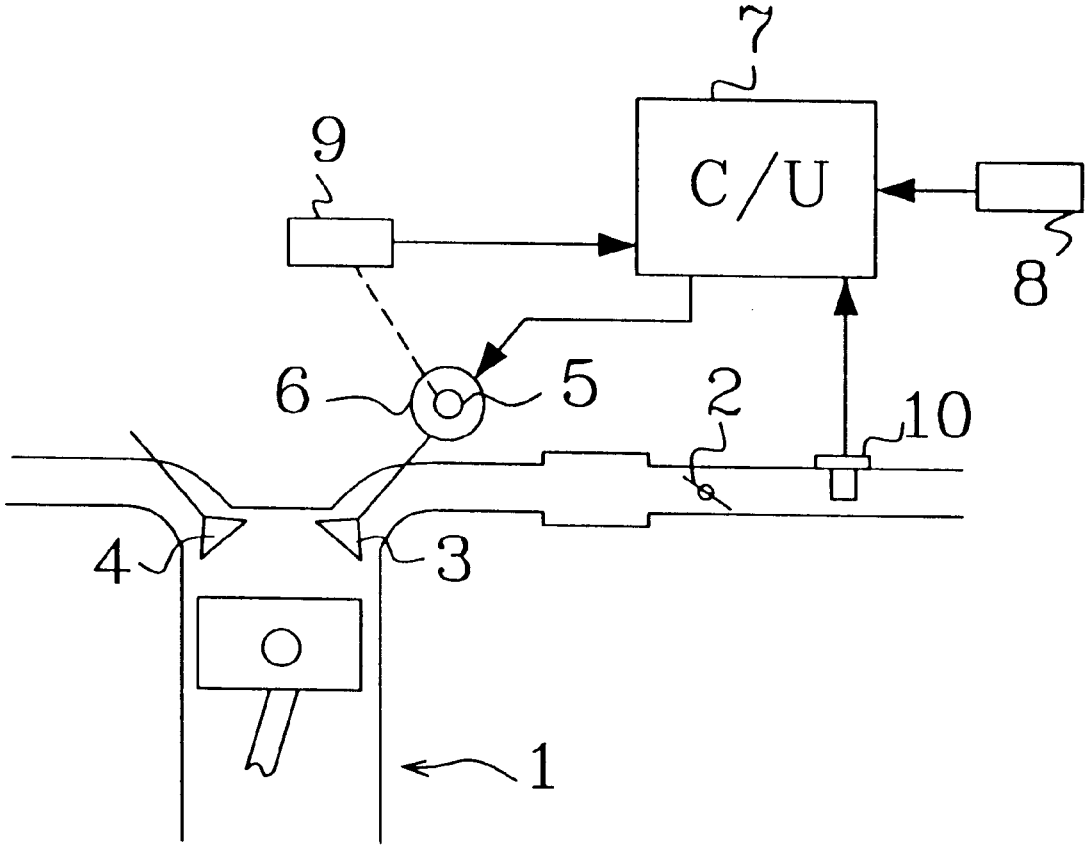
FIG. 1 is a system structure of an internal combustion engine according to an embodiment of the present invention.

FIG. 1 is a system structure of an internal combustion engine according to an embodiment of the present invention.

FIG. 1 shows an internal combustion engine 1 wherein air measured at a throttle valve 2 is supplied into a cylinder through an intake valve 3, and combusted exhaust is discharged through an exhaust valve 4. The intake valve 3 and the exhaust valve 4 are open/close driven by a cam mounted to each of an intake side cam shaft and an exhaust side cam shaft.

On an intake side cam shaft 5 is equipped with a variable valve timing structure 6 for continuously advancing or delaying the opening/closing timing of the intake valve 3 by changing the rotational phase of the cam shaft.

The variable valve timing structure 6 is constructed to continuously change the rotational phase by hydraulic pressure, wherein the rotational phase of the cam shaft is controlled by controlling the current provided to a linear solenoid valve (not shown in the drawing) for adjusting the hydraulic pressure in correspondence to an ON duty of a current control signal outputted from a control unit 7. Further, the most delayed angle side and the most advanced angle side of the rotational phase are set to be limited by a stopper, and when the ON duty is increased, it is formed to contact the stopper on the most advanced angle side before reaching 100%, and when the ON duty is decreased, it is formed to contact the stopper on the most delayed angle side before reaching 0% (refer to FIG. 4).

Further, in the present embodiment, the variable valve timing structure 6 is constructed to change the opening/closing timing of the intake valve 3, however, the variable valve timing structure 6 can be constructed to change the opening/closing timing of the exhaust valve 4 instead of the intake valve 3, or it can be constructed to change the opening/closing timing of both the intake valve 3 and the exhaust valve 4.

In the control unit 7 installing a micro computer, various signals from a crank angle sensor 8 for outputting a rotational signal of a crank shaft, a cam angle sensor 9 for outputting a rotational signal of an intake side cam shaft 5, an air flow meter 10 for detecting an intake air quantity of the engine 1, and so on are input.

Figure 2:
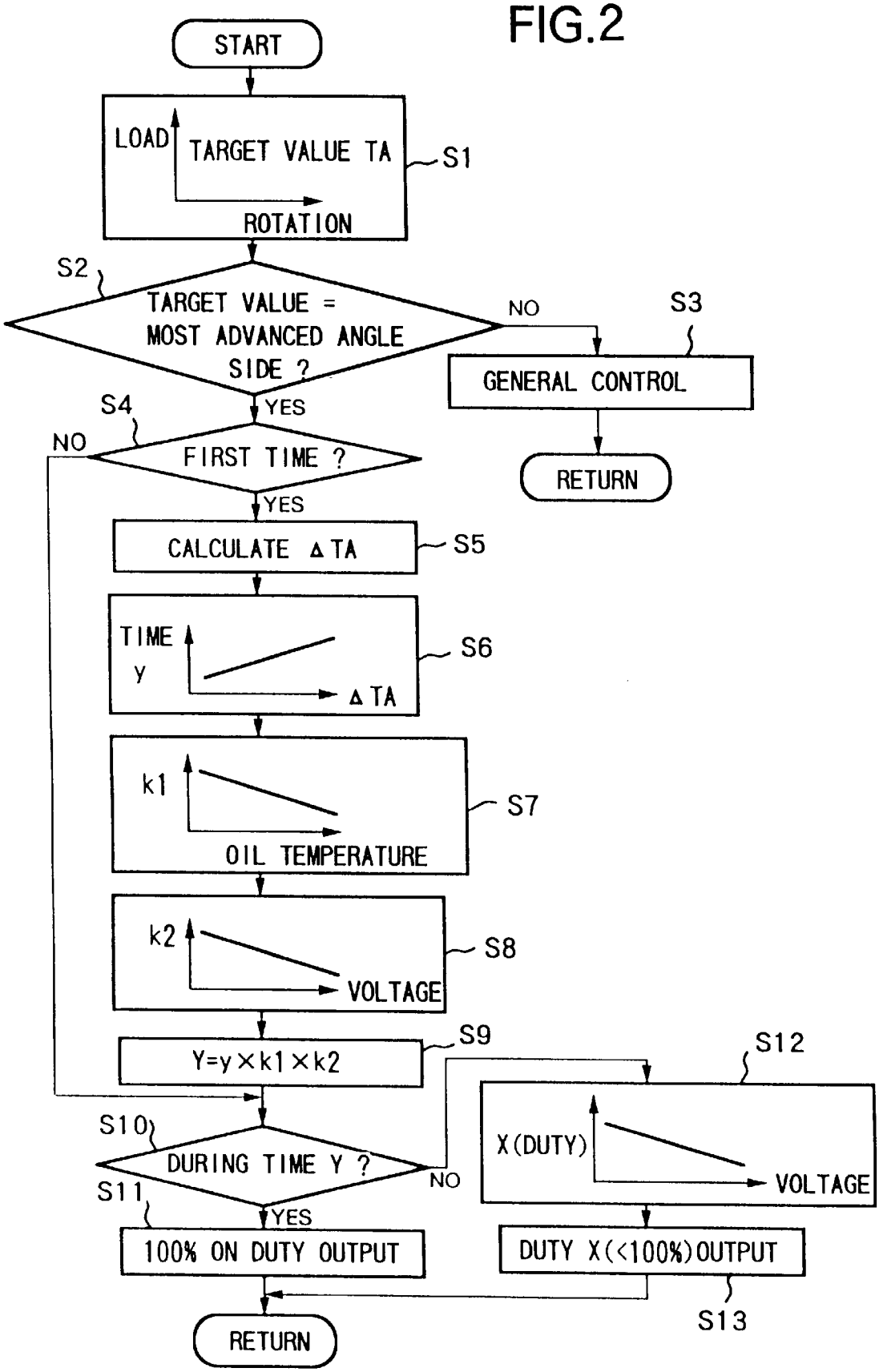
FIG. 2 is a flow chart showing the state of the valve timing control according to the embodiment.

The control unit 7 controls the opening/closing timing of the intake valve 3 adjusted by the variable valve timing structure 6 in the method shown in the flowchart of FIG. 2. Further, in the present embodiment, the function as a target value setting device, a general control device and a current control device are equipped by the control unit 7 as software, which is shown in the flowchart of FIG. 2.

According to the flow chart of FIG. 2, in step S1, by referring to a map having in its memory a target value (target angle) TA of the rotational phase of the intake side cam shaft 5 for each driving region previously divided by an engine load and an engine rotational speed Ne, the target value (target angle) TA corresponding to the present engine load and the present engine rotational speed Ne are searched.

In step S2, it is judged whether or not the target value TA set in the step S1 is in a most advanced angle side restricted by the stopper.

When the target value TA is not in the most advanced angle side, the procedure advances to step S3, where a current control signal of a duty previously set according to the target value TA is output to the linear solenoid valve. Further, when the most delayed angle side is the target value TA, a 0% ON duty is output which is the smallest value of the duty for gaining the most delayed angle.

On the other hand, when the target value TA is the most advanced angle side, the procedure advances to step S4, where it is judged whether or not it is the first time the target value TA is switched to the most advanced angle side.

If it is the first time, procedure advances to step S5, where an angle difference ΔTA between a target value $TA_{OLD}$ before being switched to the most advanced angle side and the newest target value TA which is the most advanced angle is calculated.

In step S6, a basic value y of a time Y for providing 100% ON duty (maximum current) just after the target value TA is switched to the most advanced angle side is set based on the angle difference ΔTA. In this step, the larger the angle difference ΔTA is, the longer the basic time y is set.

Figure 3:
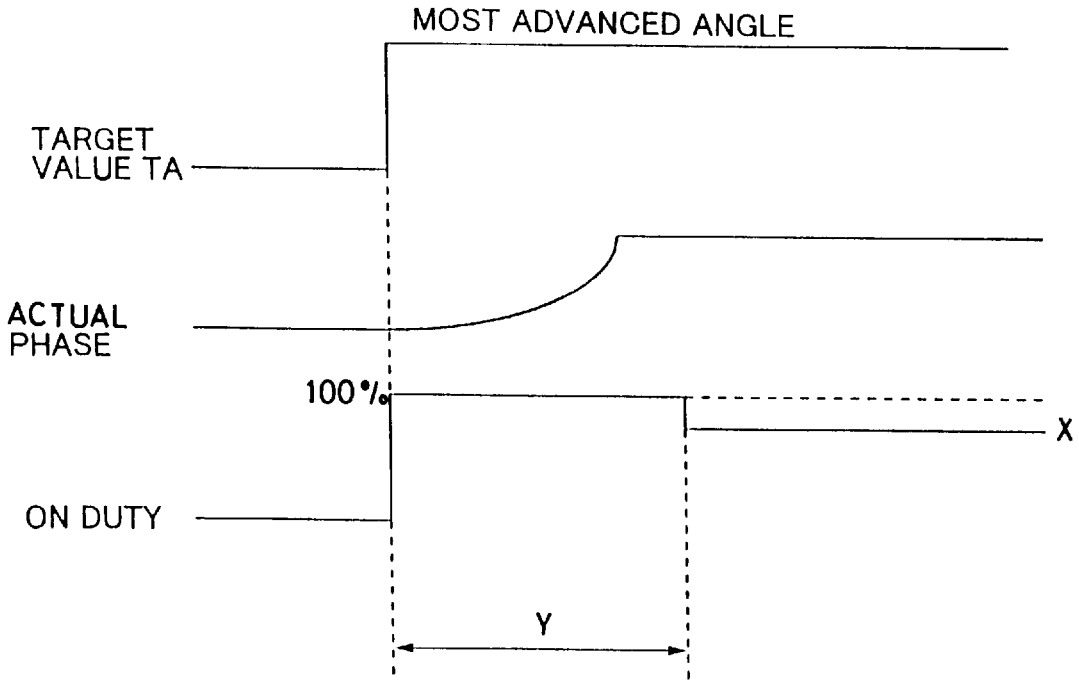
FIG. 3 is a time chart showing the control characteristics according to the embodiment.
Figure 4:
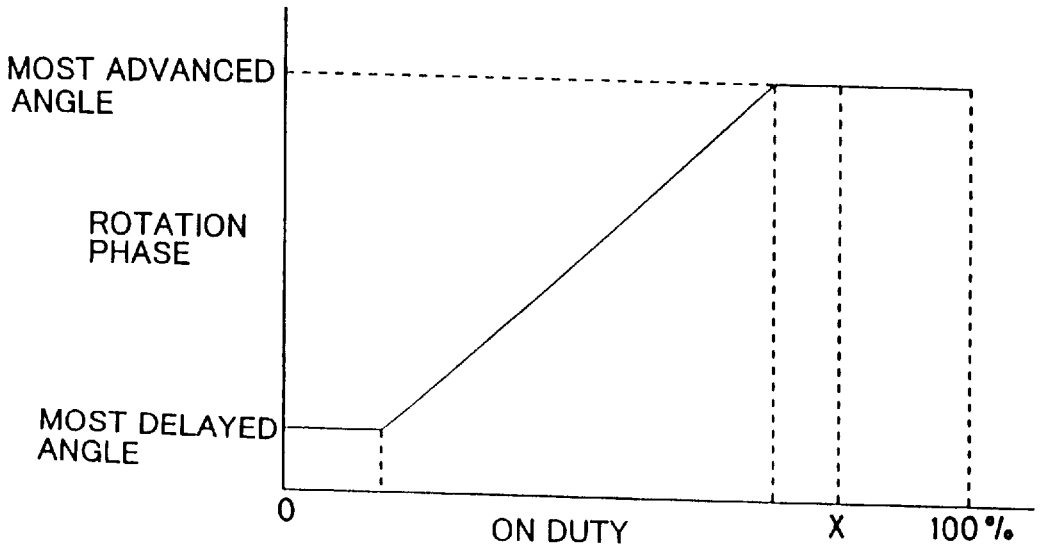
FIG. 4 is a diagram showing the correlation of the control duty and the rotational phase according to the embodiment.

In the present embodiment, during the time just after the target value TA is switched to the most advanced angle side and before the actual rotational phase is displaced to the most advanced angle side (stopper position), it is set to provide a 100% ON duty (maximum current), and after the actual rotational phase is displaced to the most advanced angle side, it is set to lower the rotational phase to a smaller duty (current) X which enables to maintain the most advanced side rotational phase, and to maintain the duty (refer to FIGS. 3 and 4).

Therefore, in step S6, corresponding to the fact that the time needed to reach the most advanced angle side becomes longer as the angle difference ΔTA becomes larger, the basic time y is set to be longer as the angle difference ΔTA (deviation of target value) becomes larger.

In step S7, a correction coefficient k1 for correcting the basic time y is set in correspondence to the temperature of the operation oil of the variable valve timing structure 6. When the temperature of the operation oil is lower, the time needed to reach the most advanced angle side becomes longer. Therefore, when the temperature of the operation oil is lower than the standard value, the correction coefficient k1 is set so as to increasingly correct the basic time y. Further, since there is a correlation between the oil temperature and the temperature of the cooling water of the engine, the basic time y may be set in correspondence to the cooling water temperature of the engine instead of the oil temperature.

In step S8, a correction coefficient k2 for correcting the basic time y is set in correspondence to the power source voltage of the linear solenoid valve. When the power source voltage is low, the current will be low even by providing 100% ON duty, and therefore, the time needed to reach the most advanced angle side becomes longer. Therefore, when the power source voltage is lower than the standard value, the correction coefficient k2 is set so as to increasingly correct the standard time y.

In step S9, the time Y for providing 100% ON duty is finally judged by (refer to FIG. 3):

$$Y=y\times k1\times k2$$

In the above embodiment, the time Y for providing the 100% ON duty is changed in correspondence to the angle difference ΔTA, the oil temperature, and the power source voltage. However, the time Y can be judged based on one or two out of the three parameters of the angle difference ΔTA, the oil temperature, and the power source voltage, or further, the time Y can be provided as a fixed value, judged by regarding the influence of the angle difference ΔTA, the oil temperature, and the power source voltage.

In step S10, it is judged whether or not it is in the range of the time Y after the target value TA is switched to the most advanced angle side. When it is in the range of the time Y, procedure is advanced to step S11, where 100% ON duty is outputted to a switching device (for example, a transistor) for controlling the current of the linear solenoid valve.

On the other hand, when it is judged in step S10 that it is not in the range of the time Y, procedure is advanced to step 12, where the ON duty for maintaining the rotational phase state in the advanced angle side is judged according to the power source voltage at that time, and then advanced to step S13, where the ON duty judged by step S12 is output.

When the procedure is advanced from step S10 to step S12, it is assumed that the rotational phase has already reached the most advanced angle side which is the target, so only a minimum current necessary for maintaining the most advanced angle may be provided, where providing 100% ON duty would mean that excessive current is provided. Therefore, when the time Y has passed after the target value TA had been switched to the most advanced angle side, it is set to reduce the duty from 100% to a lower value in the range where the most advanced angle is maintained. However, current is differed even when providing the same duty by the power source voltage, so a larger value is set as the duty when the power source voltage is lower, enabling to securely maintain a current which is just enough to maintain the most advanced angle state.

However, a duty set relatively high allowing for the reduction of power source voltage may be provided as a fixed value in step S12.

According to the above construction, when the target value TA is switched to the most advanced angle side, a 100% ON duty is provided at first so that the displacement to the most advanced angle side is performed with a good response. On the other hand, after being displaced to the most advanced angle side, current is lowered to the minimum value for maintaining such status (refer to FIGS. 3 and 4), so under the condition where the target value TA on the most advanced angle side is set continuously, the present invention enables not only to save the power consumption, but also to restrain the rise of the coil temperature of the linear solenoid valve.

What we claimed are:

1. A control apparatus of a variable valve timing structure for changing the valve timing by changing a rotational phase of a cam shaft, wherein said rotational phase is changed by adjusting a hydraulic pressure with a current control, and the change of said rotational phase corresponding to the increase of current being mechanically limited, said control apparatus comprising:

a target value setting means for setting a target value of said rotational phase based on a driving condition of an engine;

a general control means for controlling a current so as to correspond to the target value set by said target value setting means; and a current control means for controlling the current to a maximum current for a predetermined time in advance to said general control means when said target value set by said target value setting means is switched to mechanically limit the rotational phase, and for lowering and maintaining the current to a range where the mechanically limited rotational phase is maintained.

2. A control apparatus of a variable valve timing structure according to claim 1, wherein said current control means changes said predetermined time for controlling the current to said maximum current corresponding to a deviation of the target value before and after the switching.

3. A control apparatus of a variable valve timing structure according to claim 1, wherein said current control means changes said predetermined time for controlling the current to said maximum current corresponding to a temperature of an operation oil of said variable valve timing structure.

4. A control apparatus of a variable valve timing structure according to claim 1, wherein said current control means changes said predetermined time for controlling the current to said maximum current according to a power source voltage of said variable valve timing structure.

5. A control apparatus of a variable valve timing structure according to claim 1, wherein said current control means sets a basic value of said predetermined time for controlling the current to said maximum current so that the larger the deviation of the target value before and after the switching is, the larger said basic value is set, and at the same time, the higher the temperature of an operation oil of said variable valve timing structure is, the smaller said basic value is corrected, and the higher the power source voltage of said variable valve timing structure is, the smaller said basic value is corrected, thereby determining said predetermined time for providing the current to said maximum current.

6. A control apparatus of a variable valve timing structure according to claim 1, wherein said current is duty-controlled, and said current control means controls said current to a 100% ON duty for a predetermined time when the target value set by said target value setting means is switched to mechanically limit the rotational phase, and thereafter, said current control means lowers and maintains said current to an ON duty, which is set to a larger value when the power source voltage of said variable valve timing structure is lower.

7. A control apparatus of a variable valve timing structure according to claim 1, wherein the mechanically limited rotational phase is a rotational phase on a most advanced angle side in said variable valve timing structure.

8. A control method of a variable valve timing structure for changing the valve timing by changing a rotational phase of a cam shaft, wherein said rotational phase is changed by adjusting a hydraulic pressure with a current control, and the change of said rotational phase corresponding to an increase of current being mechanically limited, the control method comprising:

lowering and maintaining the current in a range where the rotational phase is mechanically limited when a target value of said rotational phase is switched to the mechanically limited rotational phase, after controlling the current to a maximum current for a predetermined time.

9. A control method of a variable valve timing structure according to claim 8, wherein said predetermined time for controlling the current to said maximum current is changed corresponding to a deviation of the target value before and after the switching.

10. A control method of a variable valve timing structure according to claim 8, wherein said predetermined time for controlling the current to said maximum current is changed corresponding to a temperature of an operation oil of said variable valve timing structure.

11. A control method of a variable valve timing structure according to claim 8, wherein said predetermined time for controlling the current to said maximum current is changed corresponding to a power source voltage of said variable valve timing structure.

12. A control method of a variable timing structure according to claim 8, wherein the predetermined time for controlling the current to said maximum current is judged by setting a basic value of said predetermined time for controlling the current to said maximum current so that the larger the deviation of the target value before and after the switching is, the larger said basic value is set, and at the same time, the higher the temperature of an operation oil of said variable valve timing structure is, the smaller said basic value is corrected, and the higher the power source voltage of said variable valve timing structure is, the smaller said basic value is corrected.

13. A control method of a variable valve timing structure according to claim 8, wherein said current is duty-controlled, and said current is controlled to a 100% ON duty for a predetermined time when the target value of the rotational phase is mechanically limited, and thereafter, said current is lowered and maintained to an ON duty, which is set to a larger value when the power source voltage of said variable valve timing structure is lower.

14. A control method of a variable valve timing structure according to claim 8, wherein the mechanically limited rotational phase is a rotational phase on a most advanced angle side in said variable valve timing structure.

* * * * *